US005657589A

United States Patent [19]

De Bood

[11] Patent Number: 5,657,589

[45] Date of Patent: Aug. 19, 1997

[54] SWIMMING POOL BASIN HAVING AN ADJUSTABLE PARTITION WALL

[75] Inventor: Alfred John De Bood, Julianadorp, Netherlands

[73] Assignee: Polymarin B.V., Medemblik, Netherlands

[21] Appl. No.: 558,853

[22] Filed: Nov. 15, 1995

[30] Foreign Application Priority Data

Nov. 16, 1994 [NL] Netherlands ..... 9401914

[51] Int. Cl.[6] ..... E04H 4/14

[52] U.S. Cl. ..... 52/169.7; 52/64; 52/125.1; 52/126.5; 4/496; 4/505

[58] Field of Search ..... 52/122.1, 123.1, 52/126.1, 125.1, 126.5, 126.6, 64, 169.7, 66; 4/489, 494, 488, 496, 505

[56] References Cited

U.S. PATENT DOCUMENTS

| | | | |
|---|---|---|---|
| 4,292,696 | 10/1981 | Berger | 4/505 |
| 5,347,773 | 9/1994 | Thil | 52/64 X |

FOREIGN PATENT DOCUMENTS

| | | | |
|---|---|---|---|
| 2187600 | 1/1974 | France . | |
| 2118991 | 10/1972 | Germany | 4/505 |
| 2328181 | 1/1974 | Germany . | |
| 2261404 | 6/1974 | Germany | 52/126.5 |
| 404085464 | 3/1992 | Japan | 52/126.1 |
| 2 274 986 | 8/1994 | United Kingdom . | |

*Primary Examiner*—Wynn E. Wood
*Assistant Examiner*—Timothy B. Kang
*Attorney, Agent, or Firm*—Young & Thompson

[57] ABSTRACT

Swimming pool basin provided with a partition wall, which can be moved essentially vertically up and down, for the division of the swimming pool basin into part-basins, the partition wall comprising an oblong, essentially beam-shaped body, which extends between two mutually opposing, vertical walls of the swimming pool basin, and which partition wall can be brought into a first, operative state so as to lie with its upper limit essentially level with the water level or project above it, in which first state the swimming pool basin is sub-divided into two swimming sections, and into a second or retracted state, in which the upper limit of the partition wall is located at a good distance below the water level, enabling swimmers to swim unhindered past the partition wall along the top, the oblong body of the partition wall being directly attached by means of at least two movable guide arms to the swimming pool bottom or to a wall part of a recess made in the swimming pool bottom.

5 Claims, 2 Drawing Sheets

SWIMMING POOL BASIN HAVING AN ADJUSTABLE PARTITION WALL

The invention relates to a swimming pool basin having an adjustable partition.

FIELD OF THE INVENTION

Adjustable partition walls are used to divide a swimming pool basin into different swimmer zones, as required. For example, a division can thereby be obtained between a recreation section and a competition section. For the partition of a competition section, in particular, the known partition wall is heavily stressed by the tension of the swimming lines for the purpose of separating different, neighbouring swimming lanes from one another by means of ropes and floats. The tension of one line can in this case amount to six hundred kilograms.

BACKGROUND OF THE INVENTION

Various types of adjustable partition walls are known. For example, a partition wall is used which can be rolled along over the top side of two mutually opposing, vertical walls of the swimming pool basin and which, when out of use, is moved to one of the end-face ends of the swimming pool basin and is store there, for example, in a niche. Another known type which is relevant to the present invention relates to a "lowerable partition wall" as it is known. This can be moved downward in a retracted state to well below the water level in order to offer swimmers sufficient space to swim past the partition wall. To this end, the partition wall is housed, for example, in a recess in the swimming pool bottom.

As a result of the various requirements which are placed upon a partition wall, for example the facility to walk across it, the facility to attach swimming lines for the division into competition lanes, as well as the facility to allow a swimmer to push off from the partition wall, it must essentially be dimensionally stable. Generally, the partition wall comprises for this purpose an oblong, beam-shaped body, for example constructed from a steel frame covered with plastics panels.

It has hitherto been usual to fasten the partition wall, of whichever type, by its end-face extremities to the mutually opposing, vertical walls of the swimming pool basin. The partition wall of the lowerable type, for the upward and downward movement between the operative state and the retracted state, was guided for this purpose by its end-face ends along a rail guide on the respective vertical wall of the swimming pool basin.

This known method of fastening the partition wall to the bearing structure of the swimming pool basin has certain drawbacks attached to it. In the first place, the partition wall, which is held fast at its extremities, is subjected to considerable bending stress resulting from the tensions of the different swimmer lines attached to the partition wall. In the second place, the presence of the rail guide on the vertical walls of the swimming pool basin is visually unattractive. Apart from this, this rail guide is unreliable. The fact that the rail guide, primarily due to visual aspects, is often designed to be recessed in the vertical wall of the swimming pool basin allows dirt to accumulate therein, which can suddenly result in the guide becoming blocked. In addition, a rail guide of this type carries a risk of injury to swimmers, especially children, who are always fascinated by cracks, fissures, etc. in swimming pools with a view, for example, to sticking their fingers in there.

SUMMARY OF THE INVENTION

In the first place, the invention results in the bending stress upon the partition wall being substantially reduced, thereby enabling it to be made in lighter and cheaper construction. In the second place, the rail guide, or any other guide, between an end-face extremity of the partition wall and the vertical wall of the swimming pool basin can thus be dispensed with.

The design of the arms for connecting the partition wall to the bottom zone of the swimming pool basin can be realized in a number of ways. For example, the arms can be able to be slid telescopically in and out. They can also be made, for example, such that they can be slid in and out in a recess in the bottom zone. From the design angle, both with regard to simplicity of construction and with regard to guidance accuracy by minimizing the amount of play, it is preferable however that the arms should be of fixed length and should be connected by at least one of the extremities, via guide elements, to the partition wall or bottom construction of the swimming pool basin so as to be movable in the longitudinal direction of the partition wall as the partition wall is moved up and down. A specific embodiment of this advantageous design is explained in greater detail in the description of the figures which is hereinafter provided. On the other hand, these guide elements can be a screw spindle, for example, which, when driven, can simultaneously serve to drive via the arms the up and down movement of the partition wall. A drive facility of this kind is known per se from DE-A-2258127. This describes a height-adjustable swimming pool bottom which can be adjusted in height by means of scissor-like elements, driven by a screw spindle. In this known construction, the types of bending stress and guidance problems encountered in known partition walls do not arise.

For the sake of the simplicity of the drive mechanism, it is preferable to equip the partition wall with a buoyancy, so that the height-adjustment can be achieved, for example, using tension cables.

In order to obtain the stiffest possible behaviour of the partition wall, it is preferable to make the arms run through it as far as possible towards the top limit of the partition wall, whilst the partition wall, in its lower marginal zone, is supported in sliding, guiding or rolling arrangement against these arms, guide elements, for example, being interposed therebetween.

In order to minimize the bending stress upon the partition wall under the influence of the tension of the swimmer lines, it is further preferable to attach the arms to the partition wall in such a way that, in its operative state, there is at least one attachment point for a swimmer line located between the arm extremity connected to the partition wall and the nearest end-face extremity of the partition wall. Consequently, on both sides of the attachment between the arm and the partition wall, tensile forces acting in the same direction are exerted upon the partition wall, thereby offering a type of functioning which reduces the bending stress.

BRIEF DESCRIPTION OF THE DRAWINGS

The invention is explained in greater detail below, by way of example, with reference to an illustrative embodiment represented in the drawing, in which:

FIGS. 1 and 2 show in diagrammatic representation a swimming pool basin 1 having an adjustable partition wall 2. FIG. 2 illustrates how the partition wall 2, in the retracted state, is located well below the water level 3, enabling swimmers to swim unhindered over the partition wall 2. FIG. 3 illustrates in greater detail the structure of the partition wall 2. Viewed in cross-section, this defines an essentially inverted U-profile with on its top side a float body 4. The legs 5, which project downward on both sides, define between them a space which is accessible from below. Two arms 6 of fixed length rise up between these legs 5 from the swimming pool bottom 7 to close to the float body 4 in the partition wall 2. The width b of each arm 6 measures at least 50% of the width B of the partition wall 2. At its extremity facing the partition wall 2, each arm 6 is guided between two slotted guides 8, which hold the arm 6 trapped between them in a virtually play-free manner. As a result of the slotted guide elements 8, the respective extremity of the arms 6 is displaceable in the longitudinal direction of the partition wall 2 in aid of the up and down movement, as is represented more specifically in FIGS. 1 and 2. At the extremity close to the swimming pool bottom 7, each arm 6 is trapped in an articulated manner between two retaining elements 9 so as to be connected thereto in an essentially play-free manner. In the proximity of their free bottom margins, the legs 5 of the partition wall 2 possess supporting strips 10 running in the longitudinal direction of the partition wall 2, which rest with some pretensioning against the arms 6 on both sides and are displaceable along them. As illustrated, tension cables 11, accommodated between the arms 6, are connected to the partition wall 2. On the other hand, the tension cables are connected to a drive (not represented in greater detail) denoted by the reference numeral 12. By shortening and letting out the tension cables 11, the partition wall 12 can be moved downward and upward respectively. The buoyancy of the float 4 is sufficient to achieve in driving action the state represented in FIG. 1, with the partition wall 2 partially above the water level 3. At the end-face extremities of the essentially parallelepipedal, oblong, beam-shaped partition wall 2, there is respectively fitted a seal 13 with the respective vertical side wall 14 of the swimming pool basin 1. These are, for example, sealing rubbers. They can be connected, for example, to the partition wall 2 and are guided in sliding arrangement along the vertical wall 14. Thus, in the uppermost zone of the swimming pool basin 1, there is no visible sign of the presence of a partition wall 2, provided that it is in its retracted state (FIG. 2).

Furthermore, FIG. 3 shows how a swimming line 16 is attached at the fastening point 15 to the partition wall 2. In the case, for example, of a twenty-five meter wide swimming pool, in which the length of the partition wall thus likewise measures twenty-five meters, the swimming pool will usually be divided across its width for competitions into nine or ten competition lanes, which are separated from one another by respective swimming lines 16. Such swimming lines 16 usually have an interspace of two to two-and-a-half meters, whilst the swimming line directly adjacent to the side wall 14 keeps an extra distance of approximately half a meter or one meter from the side wall 14.

Figure 1:
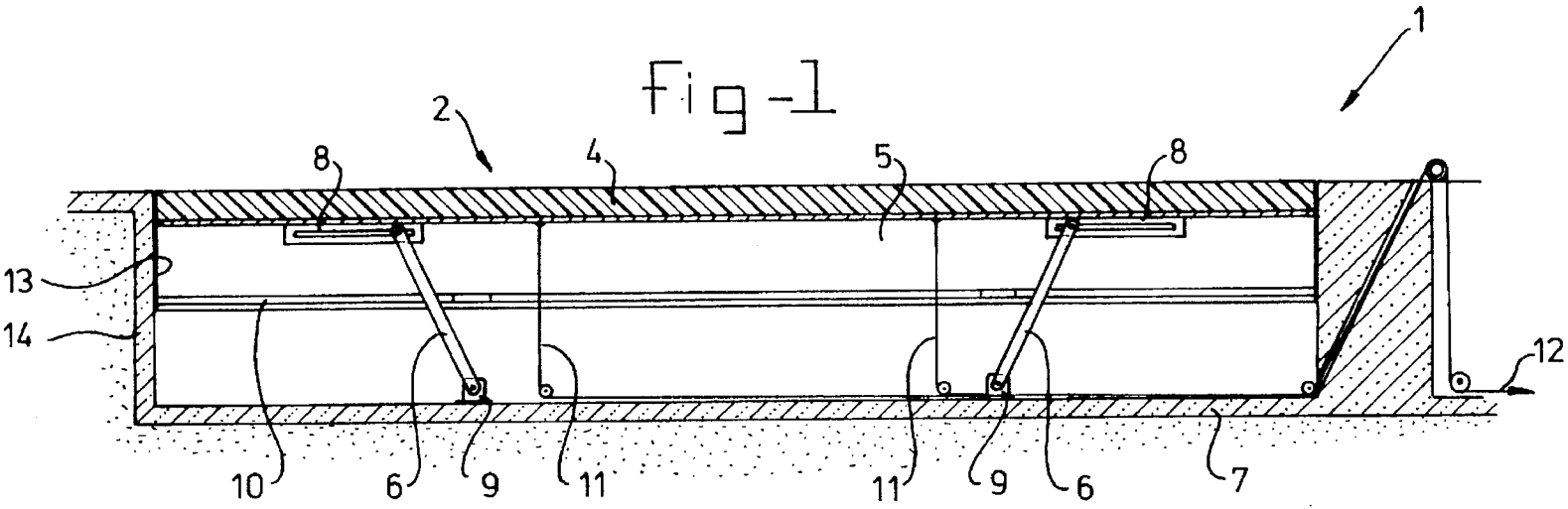
FIG. 1 shows a side view in cross-section through a swimming pool basin having an adjustable partition wall, the partition wall being represented in the operative state.
Figure 2:
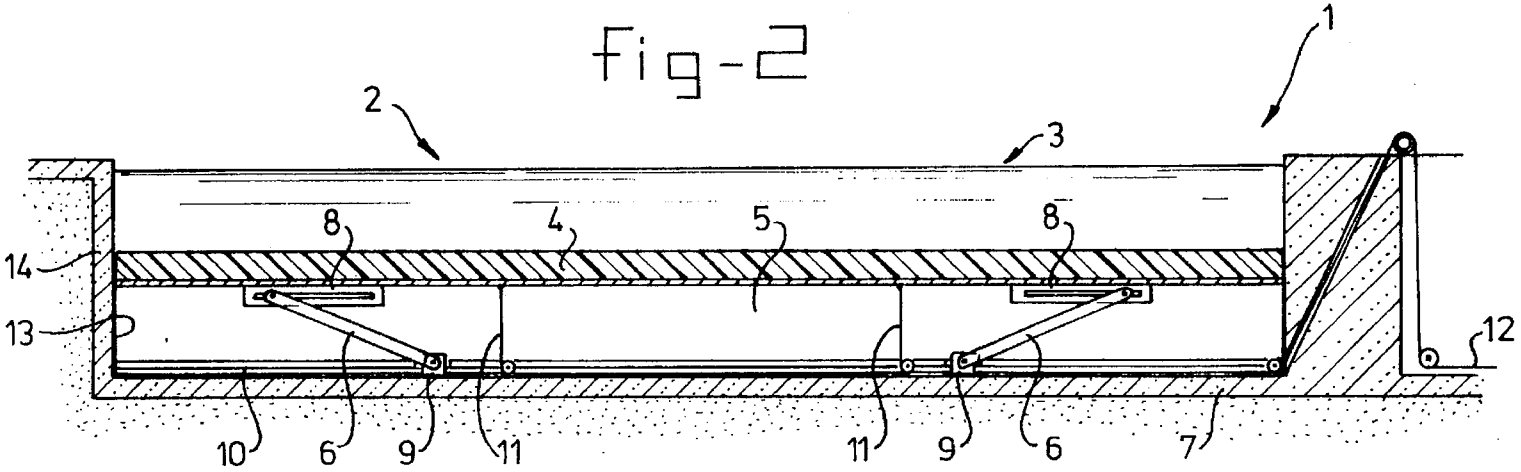
FIG. 2 shows a view according to FIG. 1, the partition wall being represented in the retracted state.
Figure 3:
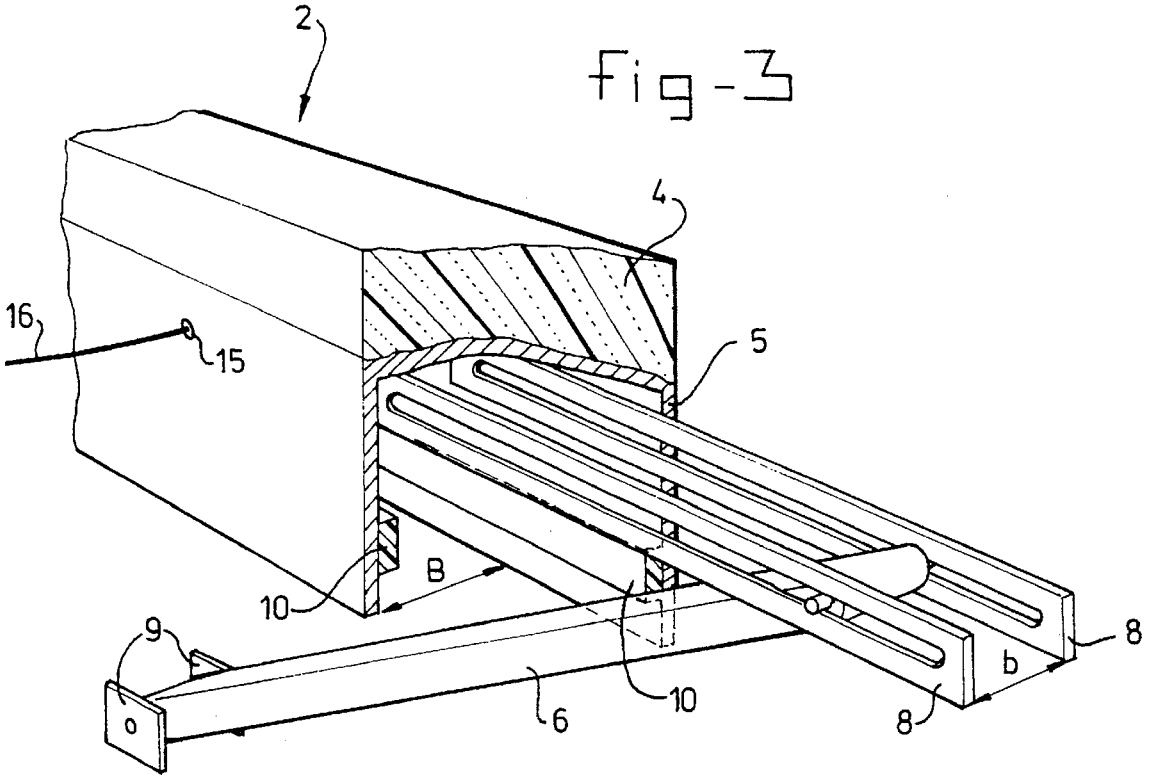
FIG. 3 shows a perspective view, partially fragmented and partially in cross-section, in which the fastening of the partition wall by means of the guide arm is represented in greater detail.

Although less expedient, it might also be possible to exchange the guide strips 8 and retaining elements 9. Moreover, it is also possible for the arms 6, along the outside, to grip around the guide strips 8 and retaining elements 9 respectively, thereby enabling the width of the arms 6 to be enlarged still further. In order to achieve a good, virtually play-free fastening between the arm 6 and the elements 8 and 9, it is preferable however to make use of two strips 8 and plates 9 respectively, which are spaced a good distance apart, whilst the arm 6 respectively possesses a width of at least such a size that it substantially fills the space between these strips 8 and plates 9 respectively.

It is also possible, of course, to deploy more than two arms 6. In the case, for example, of four or six arms 6, two sets can be formed, wherein, within each set, the arms 6 can respectively be slid in and out or tilted in and out in the same direction.

Another option is to attach the arms 6 in an articulated manner to both the bottom and the partition wall at a fixed location and to make the arm 6 in articulated construction.

I claim:

1. A swimming pool basin having a partition wall, which can be moved essentially vertically, for the division of the swimming pool basin into part-basins, the partition wall comprising an oblong, essentially beam-shaped body possessing buoyancy, which extends between two mutually opposing, vertical walls of the swimming pool basin, said partition wall having a first, operative state so as to lie with its upper limit essentially level with a water level or project above said water level, in which first state the swimming pool basin is sub-divided into two swimming sections, said partition wall having a second, retracted state, in which the upper limit of the partition wall is located at a distance below the water level, enabling swimmers to swim unhindered past the partition wall, the oblong body of the partition wall being directly attached by means of at least two movable guide arms to one of a swimming pool bottom and on a wall part of a recess made in the swimming pool bottom, a first end of the guide arms being attached to a fixed hinge point on one of the swimming pool bottom and the oblong body, a second end being attached to a guide means so as to be movable in the lengthwise direction of the oblong body, traction means between the oblong body and the swimming pool bottom, the traction means being attached to a drive for lengthening and shortening the traction means for vertical movement of the partitioning wall.

2. A swimming pool basin having a partition wall according to claim 1 wherein the guide arms possess a width measuring at least 50% of the width of the oblong body of the partition wall.

3. A swimming pool basin having a partition wall according to claim 1, wherein the arms run obliquely from the swimming pool bottom to the oblong body of the partition wall in the direction of a nearest end-face end of the oblong body of the partition wall.

4. A swimming pool basin having a partition wall according to claim 1, wherein the oblong body of the partition wall, viewed in cross-section, is an essentially inverted U-shape, the arms, reaching between the legs, extending to be close to the body of the inverted U-shaped profile, and the legs of the inverted U-shaped profile bearing at their free extremity zone a guide element, on their side facing the opposite leg, which guide element interacts supportively with the arm.

5. A swimming pool basin having a partition wall according to claim 1, wherein the oblong body of the partition wall is provided with fastening points, distributed over the length of the body, for the attachment of swimming lines for dividing the part-basin into swimming lanes, for example for swimming-race competitions, at least one fastening point being located, in the operative state, between the attachment of one arm to the partition wall and an end-face end of the said body lying closest to that attachment.

* * * * *